US005657297A

United States Patent [19]

Honda

[11] Patent Number: 5,657,297

[45] Date of Patent: Aug. 12, 1997

[54] CLOCK APPARATUS HAVING HIGH ACCURACY

[75] Inventor: Yasufumi Honda, Kawasaki, Japan

[73] Assignee: Fujitsu Limited, Kawasaki, Japan

[21] Appl. No.: 378,972

[22] Filed: Jan. 27, 1995

[30] Foreign Application Priority Data

Jan. 28, 1994 [JP] Japan ..... 6-008072

[51] Int. Cl.[6] ..... G04C 11/00; G04B 9/00; G04B 1/00

[52] U.S. Cl. ..... 368/46; 368/64; 368/66

[58] Field of Search ..... 368/66, 155–156, 368/200–202, 203, 204, 46, 47, 52, 64; 331/1 R, 1 L, 17, 18, 25; 364/569

[56] References Cited

U.S. PATENT DOCUMENTS

| | | | |
|---|---|---|---|
| 3,166,888 | 1/1965 | Kartaschoff | 368/201 |
| 3,902,311 | 9/1975 | Chacon et al. | 368/64 |
| 4,358,836 | 11/1982 | Tohyama et al. | 368/47 |
| 4,427,302 | 1/1984 | Watanabe | 368/201 |
| 4,456,386 | 6/1984 | Dellea | 368/201 |
| 4,582,434 | 4/1986 | Plangger et al. | 368/46 |
| 4,879,669 | 11/1989 | Kihara et al. | 368/202 |
| 4,953,148 | 8/1990 | Lepek et al. | 368/202 |
| 5,412,624 | 5/1995 | Yocom | 368/156 |
| 5,425,004 | 6/1995 | Staffan | 368/46 |

*Primary Examiner*—Vit W. Miska

*Attorney, Agent, or Firm*—Armstrong, Westerman, Hattori, McLeland & Naughton

[57] ABSTRACT

A clock apparatus has a first clock unit, a backup power supply unit, a second clock unit, and a control unit. The first clock unit is used to count time, and the backup power supply unit is used to supply a backup power voltage to the first clock unit, when a general power supply unit does not supply a general power voltage to the clock apparatus. The second clock unit has a higher accuracy than the first clock unit. The control unit is used to adjust the time counted by the first clock unit in accordance with a specific period counted at the second clock unit, and the control unit is also used to control the resetting of an operation of the second clock unit, when the general power supply unit starts to supply the general power voltage to the clock apparatus after the general power supply unit has been stopped. Consequently, the clock apparatus has a high accuracy corresponding to the second clock unit, and has a low consumption power when the general power supply unit cannot to supply the general power voltage to the clock apparatus, so that an improved batter backup operation for the clock apparatus can be realized.

34 Claims, 5 Drawing Sheets

CLOCK APPARATUS HAVING HIGH ACCURACY

BACKGROUND OF THE INVENTION

1. Field of the Invention

The present invention relates to a clock apparatus, and more particularly, to a clock apparatus having high accuracy and for use with a computer system or the like.

2. Description of the Related Art

Recently, computer systems have been used to realize non-stop operations over periods of several years, and thus a clock apparatus having high accuracy and a battery backup function has been required. Namely, the clock apparatus must count the time, even though a general power supply unit (which is driven by using a commercial power supply) is stopped, by using a battery (backup unit) instead of the general power supply.

Conventionally, the clock apparatus is, for example, constituted by a crystal clock having a clock integrated circuit and a quartz resonator or by an atomic clock having higher accuracy than the crystal clock.

First, the crystal clock counts the time by dividing an oscillation frequency of the quartz resonator and counting the divided signal, and the crystal clock has an accuracy about 10 ppm/month (corresponding to ±5 ppm/month, about 30 (25.9) seconds/month). Note that the crystal clock consumes little power, and thus a backup operation using a battery can be realized. However, the accuracy of the crystal clock is not sufficient for use with a continuously operating computer system or the like, since the accuracy of the crystal clock depends on various factors, e.g., the precision of the quartz resonator, the oscillation frequency of the quartz resonator which changes in accordance with a temperature, and the power supply voltage for driving the crystal clock.

On the other hand, the atomic clock counts the time by measuring a frequency radiated from an atom (for example, Cs: Cesium), and the atomic clock has an accuracy better than 0.5 ppm/month (corresponding to ±0. 25 ppm/month, about 1 (1.29) second/month). Note that the atomic clock has higher accuracy (sufficient for use with the continuously operating computer system) than the crystal clock, but consumes a large amount of power, so that a backup operation using a battery cannot be realized. Namely, in the case that the atomic clock is applied to a continuously operating computer system (for example, non-stop host computer, or non-stop server), when a general power supply stops providing general power (general power voltage) to the clock apparatus including the atomic clock, the atomic clock cannot in practice be driven by a battery.

Therefore, in the prior art, non-stop host computer or non-stop server including a clock apparatus having high accuracy, corresponding to that of an atomic clock, can not be provided.

SUMMARY OF THE INVENTION

An object of the present invention is to provide a clock apparatus having high accuracy and battery backup function for realizing a non-stop operation.

According to the present invention, there is provided a clock apparatus comprising a first clock unit for counting time; a backup power supply unit for supplying a backup power voltage to the first clock unit, when a general power supply unit does not supply a general power voltage to the clock apparatus; a second clock unit having a higher accuracy than the first clock unit; and a control unit for adjusting the time counted by the first clock unit in accordance with a specific period counted by the second clock unit, and for controlling the resetting of an operation of the second clock unit, when the general power supply unit starts to supply the general power voltage to the clock apparatus after the general power supply unit has been stopped.

The second clock unit may be a one-minute timer, and the control unit may adjust the time counted by the first clock unit at each minute counted by the second clock unit.

The first clock unit may comprise a crystal clock, and the second clock unit comprises an atomic clock. The crystal clock may comprise a clock integrated circuit and a quartz resonator. The general power supply unit may generate the general power voltage by using a commercial power source. The backup power supply unit may comprise a battery.

Further, according to the present invention, there is provided a clock apparatus comprising a clock unit for counting time; a backup power supply unit for supplying a backup power voltage to the clock unit, when a general power supply unit does not supply a general power voltage to the clock apparatus; a control unit for adjusting the time counted by the clock unit, in accordance with a reference time signal having higher accuracy than the crystal clock supplied from an external of the clock apparatus.

The control unit may adjust the time counted at the clock unit in accordance with the reference time signal by a specific time interval. The reference time signal may be a time-information service signal, and the time-information service signal may be supplied through a communication unit. The communication unit may include a modulator and demodulator or adapter for receiving the time-information service signal through a telephone line.

The reference time signal may be a standard time signal, and the standard time signal may be supplied through a communication unit. The communication unit may include a receiver for receiving the standard time signal transmitted by radio waves.

The clock unit may comprise a crystal clock. The crystal clock may comprise a clock integrated circuit and a quartz resonator. The general power supply unit may generate the general power voltage by using a commercial power source. The backup power supply unit may comprise a battery.

Further, according to the present invention, there is provided a computer having a CPU for carrying out various processes, a memory for storing data, an I/O unit for inputting and outputting various data and signals between the computer and external devices, a bus unit for transferring data or various signals between the CPU, the memory, and the I/O unit, a general power supply unit, and a clock apparatus, wherein the clock apparatus comprises a first clock unit for counting time; a backup power supply unit for supplying a backup power voltage to the first clock unit, when the general power supply unit does not supply a general power voltage to the clock apparatus; a second clock unit having a higher accuracy than the first clock unit; and a control unit for adjusting the time counted by the first clock unit in accordance with a specific period counted by the second clock unit, and for controlling the resetting of an operation of the second clock unit, when the general power supply unit starts to supply the general power voltage to the clock apparatus after the general power supply unit has been stopped.

According to the present invention, there is also provided a computer having a CPU for carrying out various processes, a memory for storing data, an I/O unit for inputting and outputting various data and signals between the computer and external devices, a bus unit for transferring data or various signals between the CPU, the memory, and the I/O unit, a general power supply unit, and a clock apparatus, wherein the clock apparatus comprises a clock unit for counting time; a backup power supply unit for supplying a backup power voltage to the clock unit, when the general power supply unit does not supply a general power voltage to the clock apparatus; a control unit for adjusting the time counted by the clock unit, in accordance with a reference time signal having higher accuracy than the crystal clock supplied from an external of the clock apparatus.

The computer may be used as a server or host computer in a computer system.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

First the principle of a clock apparatus according to the present invention will be explained.

Figure 1:
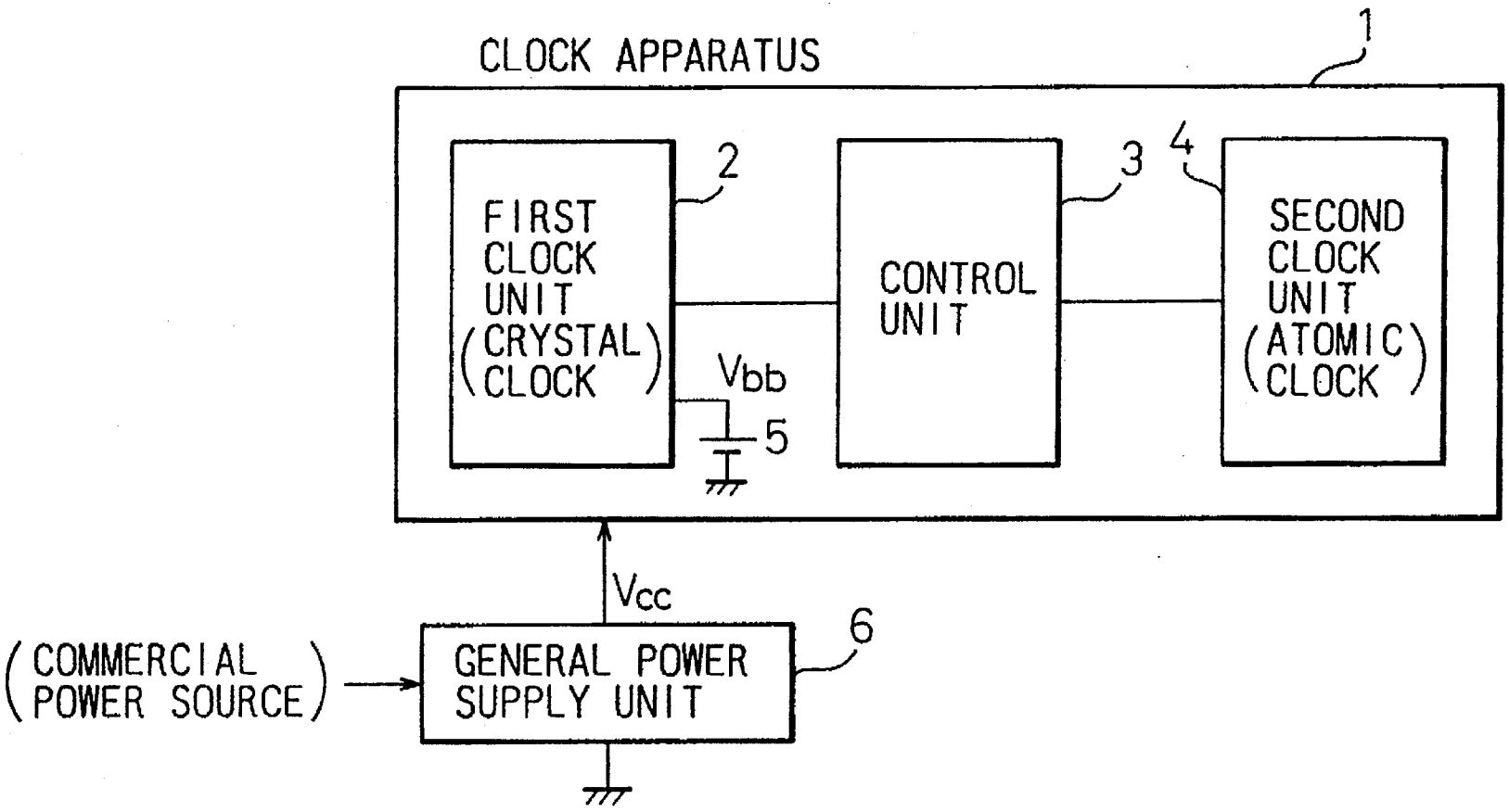
FIG. 1 is a block diagram showing a principle of a clock apparatus according to the present invention.

FIG. 1 shows a principle of a clock apparatus according to the present invention. In FIG. 1, reference numeral 1 denotes a clock apparatus, 2 denotes a first clock circuit, 3 denotes control circuit, 4 denotes a second clock circuit, 5 denotes a backup power supply unit (battery), and 6 denotes a general power supply unit.

The first clock circuit 2, which is, for example, a crystal clock, counts time. The second clock circuit 4 is used to adjust the time counted by the first clock circuit 2 by a specific period, e.g., every minute (at minute intervals). This second clock circuit 4 is, for example, an atomic clock having higher an accuracy than the crystal clock (first clock circuit 2). Note that the atomic clock consumes a large amount of power, and thus the atomic clock cannot be driven by the battery. Namely, the second clock circuit 4 (atomic clock) cannot be driven by the battery (backup power supply unit 5) in practice, and the second clock circuit 4 must be driven by the general power supply unit 6.

The general power supply unit 6 applies general power (general power voltage Vcc) to the clock apparatus which includes the first clock circuit 2 and second clock circuit 4, and the general power supply unit 6 generates a general power voltage Vcc by using a commercial power source (for example, AC 117 volts, AC 100 volts, or AC 200 volts). The backup power supply unit (battery) 5 is used to supply backup power (backup power voltage Vcc) to the first clock circuit 2, when the general power supply unit 6 cannot supply the general power voltage Vcc to the clock apparatus 1, for example, when a service interruption (power failure) of the commercial power source occurs.

The control circuit 3 is used to control a reset operation of the second clock circuit 4 when the general power supply unit 6 starts to supply the general power voltage Vcc to the clock apparatus 1 after the stop operation of the general power supply unit 6 has been stopped, for example, when the service interruption is finished and the commercial power source is restored.

As described above, in a normal operation, a general power voltage (stable voltage) Vcc output from the general power supply 6 is applied to the clock apparatus 1, and the time counted by the first clock circuit 2 is adjusted by the second clock circuit 4 at a specific interval (for example, every minute). On the other hand, for example, during a service interruption, or when the general power supply unit 6 does not supply the general power voltage Vcc to the clock apparatus 1, the second clock circuit 4 is stopped and the adjustment operation using the second clock circuit 4 is stopped, and only first clock circuit 2 is driven by the battery (backup power supply unit) 5.

Namely, during the service interruption, only the first clock circuit 2 is driven, and thus the power consumption of the clock apparatus 1 can be small. In this case, the accuracy of the clock apparatus 1 only depends on the accuracy of the first clock circuit (crystal clock) 2 which has a lower accuracy than the second clock circuit (atomic clock) 4. However, the period when the general power supply unit 6 is stopped, e.g., the period of the service interruption, is generally short, and thus the accuracy of the clock apparatus 1 does not change much in practice.

Further, when the service interruption of the commercial power source ends, that is, when the general power supply unit 6 starts to supply the general power voltage Vcc to the clock apparatus 1, the second clock circuit 4 is reset by a reset signal output from the control circuit 3, and the second clock circuit 4 begins to adjust the time counted during the first clock circuit 2 by a specific period (for example, every minute), as in normal.

Next, the preferred embodiments of a clock apparatus according to the present invention will be explained, with reference to the accompanying drawings.

Figure 2:
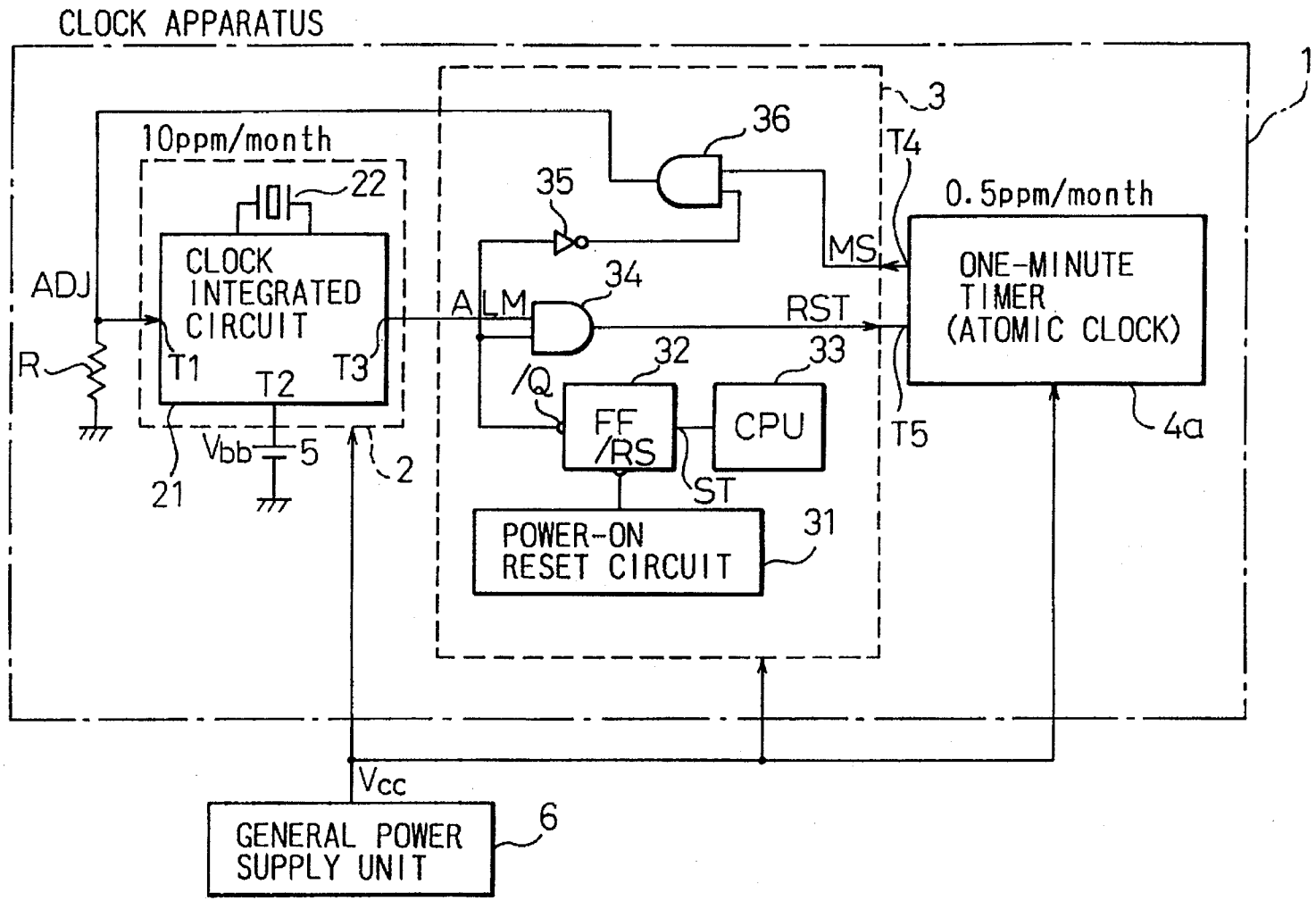
FIG. 2 is a circuit block diagram showing a first embodiment of a clock apparatus according to the present invention.

FIG. 2 shows a first embodiment of a clock apparatus according to the present invention. In FIG. 2, reference numeral i denotes a clock apparatus, 2 denotes a crystal clock circuit (first clock circuit), 3 denotes a control circuit, **4*a* denotes a one-minute timer (atomic clock) corresponding to the second clock circuit 4 of FIG. 1, 5 denotes a backup power supply unit (battery), and 6 denotes a general power supply unit. Note that, for example, the accuracy of the crystal clock 2 is about 10 ppm/month (30 seconds/month), and the accuracy of the one-minute timer 4*a* (which is, for example, an atomic clock 4**) is better than 0.5 ppm/month (1 second/month).

The first clock circuit 2, which comprises a clock integrated circuit (clock IC) 21 and a quartz resonator 22 and is used to count time, has an adjust terminal T1, a battery-backup terminal T2, and an alarm output terminal T3. The adjust terminal T1 receives an adjust signal ADJ for adjusting the time counted by the first clock circuit 2. Namely, the counted time of the first clock circuit 2 is reset to the same minute and 00 seconds, when the value of the counted time is included in the range from 00 to 29 seconds, and the counted time of the first clock circuit 2 is reset to the next minute and 00 seconds, when the value of the counted time is included in the range from 30 to 59 seconds. Note that the adjust signal (one-minute clock pulse) ADJ, which is output from the control circuit 3, is output in accordance with an output (one-minute signal) MS from the one-minute timer 4a. Further, a resister R is provided between the adjust terminal T1 of the first clock circuit 2 and the ground GND in order to generate a specific potential at the adjust terminal T1 using the adjust signal ADJ.

As shown in FIG. 2, the battery-backup terminal T2 is connected to the battery 5, and a backup power voltage Vbb (output voltage of the battery 5) is applied to the first clock circuit 2, when the general power supply 6 does not supply the general power (general power voltage Vcc), for example, when a service interruption (power failure) of the commercial power source occurs.

Further, the alarm output terminal T3 is connected to the control circuit 3 to supply an alarm signal ALM thereto. Note that the alarm signal ALM is output at each one minute of the time counted by the first clock circuit 2, and is used to reset the one-minute timer 4a after the general power supply 6 is restarted, e.g., after the service interruption is finished and the commercial power source is again available.

Namely, the one-minute timer 4a is reset after completing the service interruption, in accordance with an reset signal RST output from the control circuit 3. This reset signal RST is output in response to the alarm signal ALM output from the first clock circuit 2. Further, the one-minute signal MS is output from the one-minute timer 4a to the control circuit 3 by every minute (at minute intervals).

As shown in FIG. 2, the control circuit 3 comprises a power-ON reset circuit 31, a flip-flop (FF) 32, a central processing unit (CPU) 33, AND gates 34 and 36, and an inverter 35. The alarm signal ALM is supplied to an input of the AND gate 34 from the alarm terminal T3 of the first clock circuit 2, and the adjust signal ADJ is supplied to the adjust terminal T1 of the first clock circuit 2 from an output of the AND gate 36. Further, the one-minute signal MS is supplied to an input of the AND gate 36 from a one-minute output signal terminal T4 of the one-minute timer 4a, and the reset signal RST is supplied to a reset terminal T5 of the one-minute timer 4a from an output of the AND gate 34. Note that the an output voltage (general power) Vcc of the general power supply unit 6 is applied to the first clock circuit 2 (clock IC 21), control circuit 3, and one-minute timer 4a. Further, an output voltage Vbb of the battery 5 is applied to the battery-backup terminal T2 of the first clock circuit 2.

In the control circuit 3, the output of the power-ON reset circuit 31 is supplied to a reset terminal (inverted level terminal) /RS of the flip-flop 32, a control signal output from the CPU 33 is supplied to a set terminal ST of the flip-flop 32, and an output (inverted level output) /Q of the flip-flop 32 is directly supplied to another input of the AND gate 34, and is supplied to another input of the AND gate 36 through the inverter 35.

The power-ON reset circuit 31 is only switched ON during a specific period after the general power supply 6 begins to supply the general power (general power voltage Vcc), for example, when a computer system having the clock apparatus 1 is switched ON, the service interruption is completed and the commercial power supply is again supplied, and the like. The CPU 33 detects a state of the general power supply 6 and controls (sets) the flip-flop 32 in accordance with the detected state of the general power supply 6.

The AND gate 34 is used to detect a conjunction of the alarm signal ALM output from the first clock circuit 2 and the output signal /Q of the flip-flop 32. Further, the AND gate 36 is used to detect a conjunction of the one-minute signal MS output from the one-minute timer 4a and the inverted signal (Q) of the output signal/Q of the flip-flop 32 through the inverter 35. Note that the first clock circuit 2 is adjusted by an output signal (adjust signal) ADJ from the AND gate 36, that is, the adjust signal ADJ is supplied to the adjust terminal T1 of the first clock circuit 2.

The first clock circuit 2 is, for example, a crystal clock having an accuracy of about 10 ppm/month (30 seconds/month), and the one-minute timer 4a is, for example, an atomic clock having an accuracy better than 0.5 ppm/month (1 second/month). Note that the accuracy of the atomic clock (one-minute timer 4a) allows the clock to output the one-minute signal MS, with better than 0.5 ppm/month accuracy, every minute regardless of fluctuations in the temperature or in the general power supply voltage Vcc.

Figures 3A, 3B, 3C:
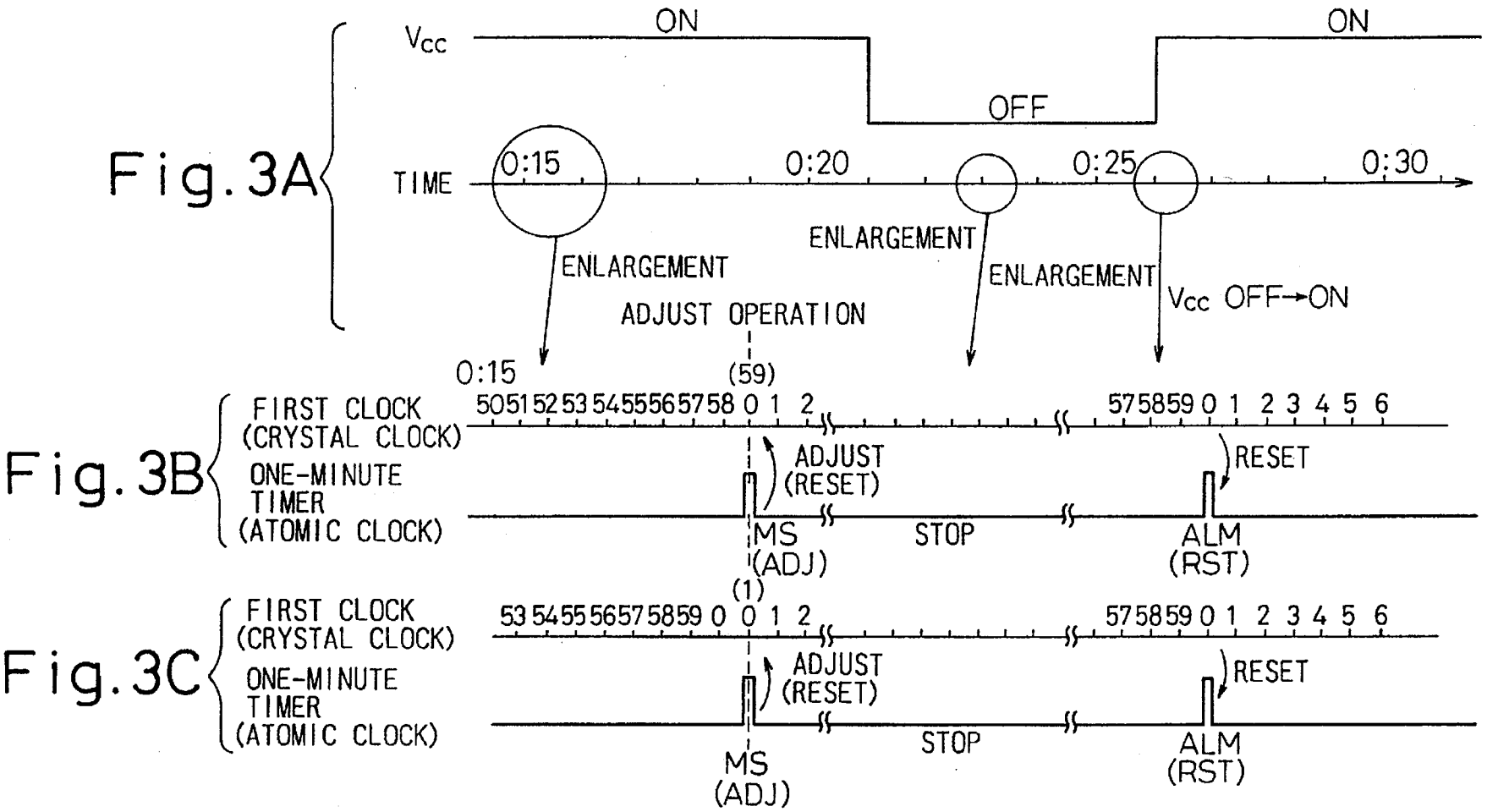
FIGS. 3A, 3B and 3C are diagrams for explaining operations of the clock apparatus shown in FIG. 2.

FIGS. 3A, 3B and 3C are diagrams for explaining the operations of the clock apparatus shown in FIG. 2. Namely, FIG. 3A shows the change in the general power supply voltage (output voltage of the general power supply 6) Vcc and the time counted by the first clock circuit (crystal clock) 2. Further, FIG. 3B and 3C show some enlarged portions in the counted time and output signal (one-minute signal MS) of the one-minute timer 4a in order to explain the adjust and reset operations of the clock apparatus according to the present invention. Note that FIGS. 3A, 3B and 3C show the case when a service interruption (power failure of a commercial power source) is caused during the time from about 0:21 to 0:26, and the general power supply 6 is stopped and cannot apply a general power voltage Vcc to the clock apparatus 1.

As shown in a left half of FIG. 3B, when the time counted by the first clock circuit 2 (counted time) advances one second during the time from 0:15 (15 minutes past midnight) to 0:16 (16 minutes past midnight), while the general power voltage Vcc is continuously applied from the general power supply 6 to the clock apparatus 1; the counted time, which is at 0 o'clock past 15 minutes and 59 seconds, is forcibly adjusted to 0 o'clock past 16 minutes and 00 seconds in accordance with the one-minute signal MS, or the adjust signal ADJ. Namely, an output signal /Q of the flip-flop 32 is at a low level "L", and this low level signal (/Q) is directly supplied to an input of the AND gate 34, and the inverted signal (high level signal (Q)) is supplied to an input of the AND gate 36 through the inverter 35. Therefore, the adjust signal ADJ is changed in response to the one-minute signal MS, and the reset signal RST is maintained at a low level "L" regardless the alarm signal ALM output from the first clock circuit 2 is at a high level "H". Namely, the counted time is adjusted by the adjust signal ADJ which is changed in response to the one-minute signal MS.

Similarly, as shown in a left half of FIG. 3C, when the counted time (time counted by the first clock circuit 2) delays one second during the time from 0:15 to 0:16, while the general power voltage Vcc is continuously applied from the general power supply 6; the counted time, which is at 16 minutes and 01 second, is forcibly adjusted to 16 minutes and 00 seconds in accordance with the one-minute signal MS, or adjust signal ADJ.

As described above, in the normal state, or when the general power voltage Vcc is continuously applied from the general power supply 6 to the clock apparatus 1, the first clock circuit 2 (which is, for example, a crystal clock) is adjusted by the one-minute timer 4a (which is, for example, an atomic clock) every minute (at minute intervals). Therefore, an output of the clock apparatus 1 (adjusted time of the first clock circuit 2) substantially has the accuracy corresponding to the atomic clock (one-minute timer 4a), that is, the output of the clock apparatus 1 has an accuracy better than 0.5 ppm/month.

Next, the case in described when the general power supply circuit 6 is stopped, the general power supply voltage Vcc is not applied to the clock apparatus 1, and the backup power voltage (output voltage of the battery 5) Vbb is applied to the first clock circuit 2 instead of the general power supply voltage Vcc, for example, when a service interruption (power failure) of the commercial power source occurs.

When the general power voltage Vcc is not applied to the clock apparatus 1, the backup power voltage Vbb is not applied to the control circuit 3 and the one-minute timer 4a which consumes a large amount of power, but the backup power voltage Vbb is only supplied to the first clock circuit 2. Namely, for example, during the service interruption, the first clock circuit 2 is only operated by supplying it with the output voltage Vbb from the battery 5. In this case, the total consumption power of the clock apparatus 1 due to the first clock circuit 2 is small, and thus the backup operation can be realized. Note that the accuracy of the clock apparatus 1 only depends on that of the first clock circuit 2 (crystal clock). Namely, the accuracy of the clock apparatus 1 (first clock circuit 2) during the service interruption is lower than that of the clock apparatus 1 during the normal state, but the service interruption is generally completed in a short time. Therefore, the error in the time counted by the first clock circuit 2 can be ignored.

Next, when the general power voltage Vcc is restored (for example, after the service interruption is completed), the general power voltage Vcc is applied to the clock apparatus 1, and the one-minute timer 4a starts to count from a random value. At this time, the general power voltage Vcc is also applied to the control circuit 3, and the power-ON reset circuit 31 is switched ON, so that the power-ON reset circuit 31 outputs a reset signal (for example, a low level signal "L") to the reset terminal /RS of the flip-flop 32. Therefore, an output signal /Q (for example, a high level signal "H") from the flip-flop 32 is directly supplied to an input of the AND gate 34, and the inverted signal (Q: low level signal "L") is supplied to an input of the AND gate 36 through the inverter 35. Therefore, an output signal (adjust signal ADJ) from the AND gate 36 is maintained at a low level "L" even though the one-minute signal MS is at a high level "H", and further, an output signal (reset signal RST) from the AND gate 34 changes to a high level "H" when the alarm signal ALM output from the first clock circuit 2 is at a high level "H". Consequently, as shown in the right halves of FIGS. 3B and 3C, the one-minute timer 4a is reset by the reset signal RST (high level signal "H") which is changed in response to the alarm signal ALM.

Note that the output signal /Q of the flip-flop 32 is brought to a low level "L" by the CPU 33 after a specific period, or after the one-minute timer 4a is reset by the reset signal RST. Therefore, the reset signal RST is maintained at a low level "L" after the reset operation of the one-minute timer 4a is completed, and the adjust signal ADJ is changed in response to the one-minute signal MS output from the one-minute timer 4a. Namely, after the one-minute timer 4a is reset by the reset signal RST, the time counted by the first clock circuit 2 is adjusted by the adjust signal ADJ, or the one-minute signal MS output from the one-minute timer 4a, as in the normal state in the above description. In this case, or when the general power voltage Vcc is continuously applied from the general power supply 6 to the clock apparatus 1 (normal state), the first clock circuit (crystal clock) 2 is adjusted by the one-minute timer (atomic clock) 4a, every minute (at minute intervals). Therefore, an output of the clock apparatus 1 (adjusted time of the first clock circuit 2) substantially has a accuracy corresponding to the atomic clock (one-minute timer 4a), that is, the output of the clock apparatus 1 has an accuracy better than 0.5 ppm/month.

Figure 4:
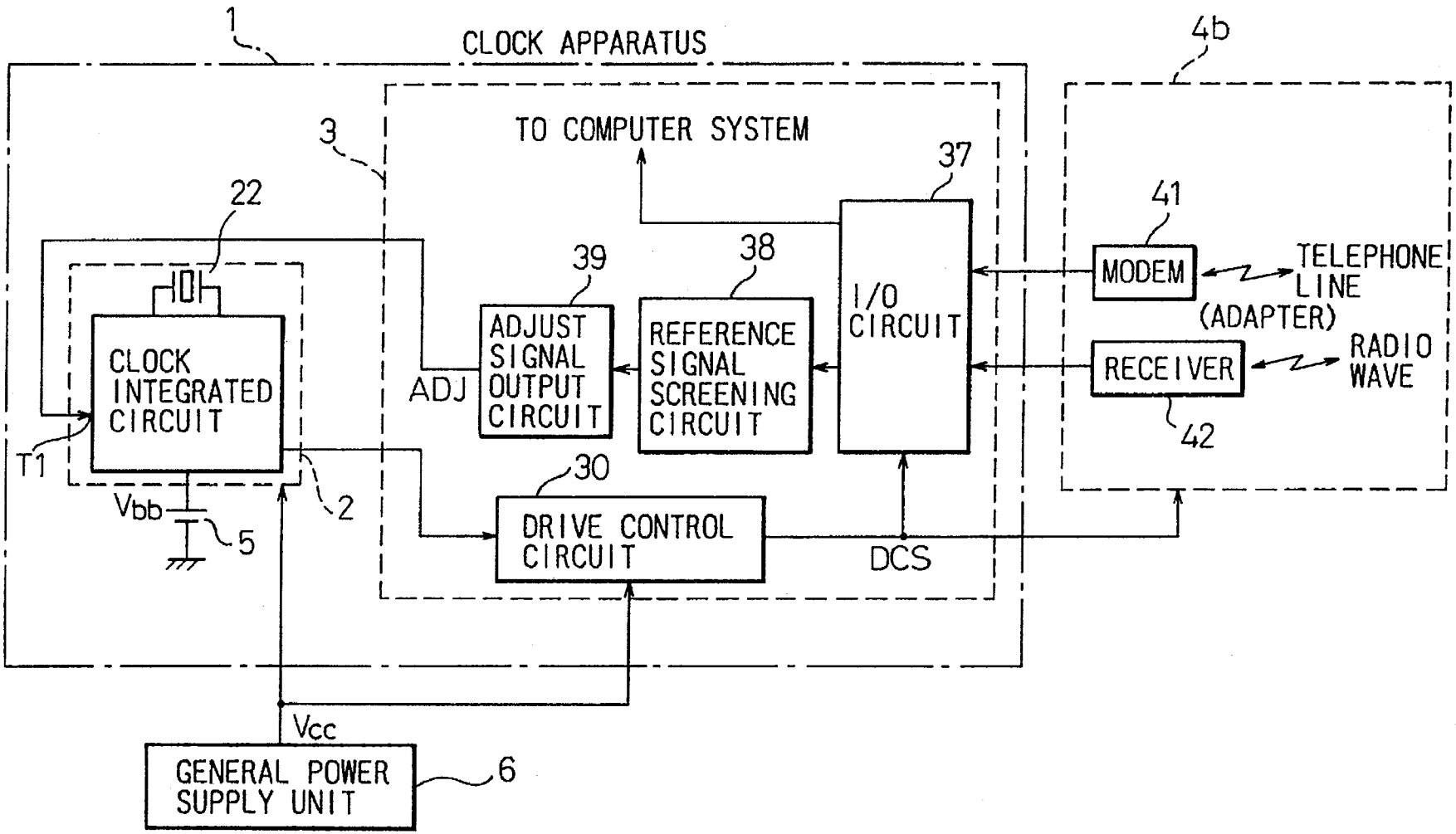
FIG. 4 is a circuit block diagram showing a second embodiment of a clock apparatus according to the present invention.

FIG. 4 shows a second embodiment of a clock apparatus according to the present invention. In FIG. 4, reference numeral 1 denotes a clock apparatus, 2 denotes a crystal clock circuit (clock circuit), 3 denotes a control circuit, 4b denotes an external device, and 5 denotes a backup power supply unit (battery), and 6 denotes a general power supply unit. Note that the external device 4b comprises a modulator and demodulator (MODEM) or adapter 41 for receiving a time-information service signal through an analog or digital telephone line; or instead that the external device 42 comprises a receiver 42 for receiving a standard time (Greenwich Mean Time: GMT, Japan Standard Time: JST, and the like) signal through a radio receiver.

As in the first embodiment shown in FIG. 2, the clock circuit 2 is used to count time and is constituted by a clock IC 21 and a quartz resonator 22. The control circuit 3 comprises an input/output circuit (I/O circuit) 37, a reference signal screening circuit 38, an adjust signal output circuit 39, and a drive control circuit 30. The drive control circuit 30 receives an output signal of the clock circuit 2 and confirms the time counted by the clock circuit 2 and then the drive control circuit 30 outputs a drive control signal DCS to the I/O circuit 37 and the external device 4a to enable (switch ON) the I/O circuit 37 and the external device 4a at a specific time interval, for example, every 4 hours (00:00:00 (00 Hours:00 Minute:00 Seconds), 04:00: 00, 08:00:00, 12:00:00, 16:00:00, 20:00:00), i.e., six times every day). In this case, the drive control signal DCS is, for example, changed to a high level during 60 seconds from 30 seconds before to 30 seconds after the specific time (23:59:30 to 00:00:30, 03:59:30 to 04:00:30, 07:59:30 to 08:00:30, 11:59:30 to 12:00:30, 15:59:30 to 16:00:30, 19:59:30 to 20:00:30), and thereby the I/O circuit 37 and the external device 4a are switched ON for 60 seconds at every 4 hours, every day.

The I/O circuit 37 is connected to the MODEM 41 or receiver 42 in order to receive the time-information service signal or standard time signal. The reference signal screening circuit 38, which is connected to the the I/O circuit 37, carries out a screening operation, that is, the reference signal screening circuit 38 selects a specific signal (for example, a time signal) from the time-information service signal or standard time signal at the specific time interval (for example, every 4 hours).

The adjust signal output circuit 39 is connected to the reference signal screening circuit 38, and the adjust signal output circuit 39 is used to generate an adjust signal which is output at the specific time interval (every 4 hours) using the time-information service signal or standard time signal. Note that an output signal (adjust signal) ADJ of the adjust signal output circuit 39 is supplied to an adjust terminal T1, so that the time counted by the clock circuit 2 is adjusted by the adjust signal ADJ every 4 hours. Namely, according to this second embodiment of the present invention, the adjust operations for the counted time (adjust operations for the clock circuit 2) are carried out six times in every day. Note that the adjust operation of the clock circuit 2 is carried out by adjusting the time counted by the clock circuit to a standard time (GMT, JST, or the like).

Note that, during a service interruption, or when the general power supply unit 6 does not supply the general power voltage Vcc to the clock apparatus 1, only first clock circuit 2 is driven by the battery (backup power supply unit) 5. In this case, the accuracy of the clock apparatus 1 depends only on the accuracy of the first clock circuit (crystal clock) 2. However, as described in the first embodiment, the period that the general power supply unit 6 is stopped, e.g., the period of the service interruption, is generally short, and thus the accuracy of the clock apparatus 1 is not decreased in practice.

In the second embodiment, a special process for recovering the service interruption is not required. Note that, when a specific time (specific one of every 4 hours) for carrying out the adjust operation of the clock circuit 2 is included in the period of the service interruption, the adjusting operation is not carried out for about eight hours (4 hours×2), however, in his case, the accuracy of the clock apparatus 1 is still not decreased. Nevertheless, if much higher accuracy is required, the specific time interval can be shortened to, for example, 3 hours or 2 hours. In addition, it is possible to modify the second embodiment in order to carry out the adjust operation of the clock circuit 2 when the general power supply unit 6 begins to apply the general power voltage Vcc to the clock apparatus 1. In this case, the drive control circuit 30 is constituted to output the drive control signal DCS, when the service interruption of the commercial power source is completed, or when the general power supply unit 6 starts to apply the general power voltage Vcc to the clock apparatus 1, so that the I/O circuit 37 and the external device **4*a* are switched ON and the adjust operation of the clock circuit 2** is carried out.

In the above second embodiment, as described above, the specific time interval is not fixed as 4 hours, but can be 8 hours, 6 hours, 3 hours, and the like. Further, the standard time is not limited to GMT or JST, and the external device **4*a* is not limited to the MODEM 41 or receiver 42**.

As explained above, according to the clock apparatus of the present invention, a clock apparatus having high accuracy and battery backup function for realizing a non-stop operation can be provided.

Figure 5:
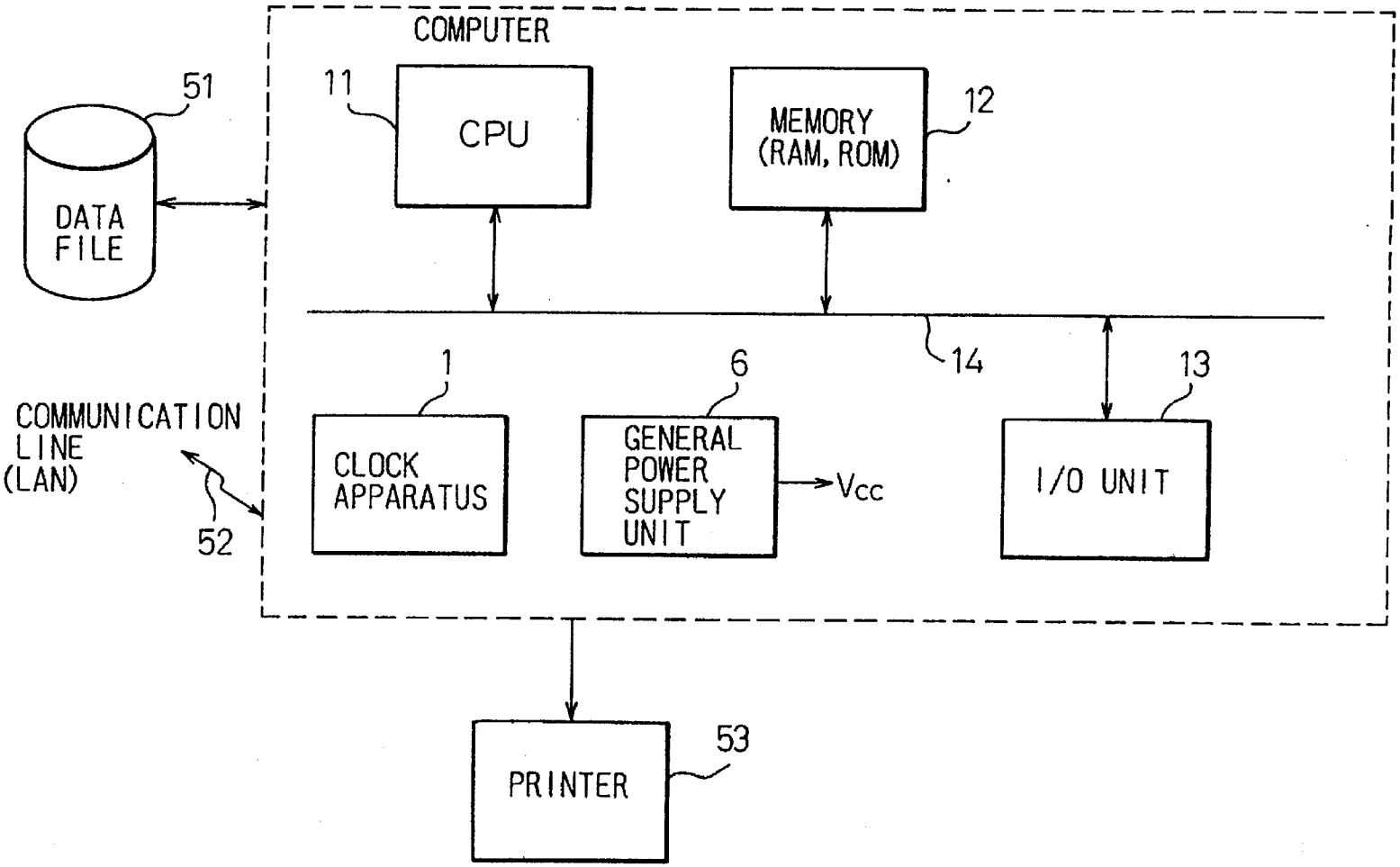
FIG. 5 is a block diagram showing an example of a computer including a clock apparatus of the present invention.

FIG. 5 shows an example of a computer including a clock apparatus of the present invention. In FIG. 5, reference numeral 11 denotes a CPU (central processing unit), 12 denotes a memory (ROM, RAM), 13 denotes an I/O unit, 14 denotes a bus.

As shown in FIG. 5, the computer comprises the CPU 11, memory 12, I/O unit 13, bus 14, general power supply unit 6, and clock apparatus 1. The general power supply unit 6 generates a general power voltage Vcc by using a commercial power source (for example, AC 117 volts, AC 100 volts, or AC 200 volts). The clock apparatus 1 has the configurations shown in FIGS. 2 and 4, and the explanations thereof are omitted.

The CPU 11 is used to carry out various processes, and the I/O unit 13 is used to input and output various data and signals between the computer and various external apparatuses, e.g., a data file 51, a printer 53, and the like. Further, the computer is connected to a plurality of terminal devices (terminal computers) through a communication line 52, e.g., a local area network (LAN).

The memory 12, which includes various types of a read only memory (ROM) and a random access memory (RAM), is used to store data, and the bus 14 is used to transfer data or various signals among the CPU 11, memory 12, and I/O unit 13.

Note that the computer including the clock apparatus 1 of the present invention is preferably used as a server (computer) or host computer in a computer system. Further, the computer shown in FIG. 5 is only an example, and various modifications can be applied. Further, in FIG. 5, the external apparatuses connected to the computer are the data file 51 and printer 53, but various external apparatuses can be connected to the computer in accordance with the requirements.

As described above, by applying the clock apparatus of the present invention to the computer (server or host computer), a non-stop host computer or non-stop server including a clock apparatus having high accuracy corresponding to that of the atomic clock can be provided.

Many different embodiments of the present invention may be constructed without departing from the spirit and scope of the present invention, and it should be understood that the present invention is not limited to the specific embodiments described in this specification, except as defined in the appended claims.

What is claimed is:

1. A clock apparatus capable of receiving a general power voltage supplied from a general power supply means, said clock apparatus comprising:

a first clock means for counting time;

a backup power supply means for supplying a backup power voltage to said first clock means, when said general power supply means does not supply said general power voltage to said clock apparatus;

a second clock means having a higher accuracy than said first clock means; and a control means for adjusting the time counted by said first clock means in accordance with a specific period counted by said second clock means, and for controlling the resetting of an operation of said second clock means, when said general power supply means starts to supply the general power voltage to said clock apparatus after said general power supply means has been stopped.

2. A clock apparatus as claimed in claim 1, wherein said second clock means is a one-minute timer, and said control means adjusts the time counted by said first clock means at each minute counted by said second clock means.

3. A clock apparatus as claimed in claim 1, wherein said first clock means comprises a crystal clock, and said second clock means comprises an atomic clock.

4. A clock apparatus as claimed in claim 3, wherein said crystal clock comprises a clock integrated circuit and a quartz resonator.

5. A clock apparatus as claimed in claim 1, wherein said general power supply means generates the general power voltage by using a commercial power source.

6. A clock apparatus as claimed in claim 1, wherein said backup power supply means comprises a battery.

7. A clock apparatus capable of receiving a general power voltage supplied from a general power supply means, said clock apparatus comprising:

a clock means for counting time;

a backup power supply means for supplying a backup power voltage to said clock means, when said general power supply means does not supply said general power voltage to said clock apparatus;

a control means for adjusting the time counted by said clock means, in accordance with a reference time signal having higher accuracy than said crystal clock supplied from a source external of said clock apparatus and for controlling the resetting of the reference time signal, when the general power supply means starts to supply the general power voltage to said clock apparatus after said general power supply means has been stopped.

8. A clock apparatus as claimed in claim 7, wherein said control means adjusts the time counted at said clock means in accordance with said reference time signal by a specific time interval.

9. A clock apparatus as claimed in claim 8, wherein said reference time signal is a time-information service signal, and said time-information service signal is supplied through a communication means.

10. A clock apparatus as claimed in claim 9, wherein said communication means includes a modulator and demodulator or adapter for receiving said time-information service signal through a telephone line.

11. A clock apparatus as claimed in claim 8, wherein said reference time signal is a standard time signal, and said standard time signal is supplied through a communication means.

12. A clock apparatus as claimed in claim 11, wherein said communication means includes a receiver for receiving said standard time signal transmitted by radio waves.

13. A clock apparatus as claimed in claim 7, wherein said clock means comprises a crystal clock.

14. A clock apparatus as claimed in claim 13, wherein said crystal clock comprises a clock integrated circuit and a quartz resonator.

15. A clock apparatus as claimed in claim 7, wherein said general power supply means generates the general power voltage by using a commercial power source.

16. A clock apparatus as claimed in claim 7, wherein said backup power supply means comprises a battery.

17. A computer having a CPU for carrying out various processes, a memory for storing data, an I/O means for inputting and outputting various data and signals between said computer and external devices, a bus means for transferring data or various signals between said CPU, said memory, and said I/O means, a general power supply means, and a clock apparatus, wherein said clock apparatus comprises:

a first clock means for counting time;

a backup power supply means for supplying a backup power voltage to said first clock means, when said general power supply means does not supply a general power voltage to said clock apparatus;

a second clock means having a higher accuracy than said first clock means; and a control means for adjusting the time counted by said first clock means in accordance with a specific period counted by said second clock means, and for controlling the resetting of an operation of said second clock means, when said general power supply means starts to supply the general power voltage to said clock apparatus after said general power supply means has been stopped.

18. A computer as claimed in claim 17, wherein said second clock means is a one-minute timer, and said control means adjusts the time counted at said first clock means at each minute counted by said second clock means.

19. A computer as claimed in claim 17, wherein said first clock means comprises a crystal clock, and said second clock means comprises an atomic clock.

20. A computer as claimed in claim 19, wherein said crystal clock comprises a clock integrated circuit and a quartz resonator.

21. A computer as claimed in claim 17, wherein said general power supply means generates the general power voltage by using a commercial power source.

22. A computer as claimed in claim 17, wherein said backup power supply means comprises a battery.

23. A computer as claimed in claim 17, wherein said computer is used as a server or host computer in a computer system.

24. A computer having a CPU for carrying out various processes, a memory for storing data, an I/O means for inputting and outputting various data and signals between said computer and external devices, a bus means for transferring dam or various signals between said CPU, said memory, and said I/O means, a general power supply means, and a clock apparatus, wherein said clock apparatus is capable of receiving a general power voltage supplied from said general power supply means, said clock apparatus comprising:

a clock means for counting time;

a backup power supply means for supplying a backup power voltage to said clock means, when said general power supply means does not supply a general power voltage to said clock apparatus;

a control means for adjusting the time counted by said clock means, in accordance with a reference time signal having higher accuracy than said crystal clock supplied from a source external of said clock apparatus and for controlling the resetting of the reference time signal, when the general power supply means starts to supply the general power voltage to said clock apparatus after said general power supply means has been stopped.

25. A computer as claimed in claim 24, wherein said control means adjusts the time counted by said clock means in accordance with said reference time signal at a specific time interval.

26. A computer as claimed in claim 25, wherein said reference time signal is a time-information service signal, and said time-information service signal is supplied through a communication means.

27. A computer as claimed in claim 26, wherein said communication means includes a modulator and demodulator or adapter for receiving said time-information service signal through a telephone line.

28. A computer as claimed in claim 25, wherein said reference time signal is a standard time signal, and said standard time signal is supplied through a communication means.

29. A computer as claimed in claim 28, wherein said communication means includes a receiver for receiving said standard time signal transmitted by radio waves.

30. A computer as claimed in claim 24, wherein said clock means comprises a crystal clock.

31. A computer as claimed in claim 24, wherein said crystal clock comprises a clock integrated circuit and a quartz resonator.

32. A computer as claimed in claim 24, wherein said general power supply means generates the general power voltage by using a commercial power source.

33. A computer as claimed in claim 24, wherein said backup power supply means comprises a battery.

34. A computer as claimed in claim 24, wherein said computer is used as a server or host computer in a computer system.

* * * * *